US010989194B2

(12) United States Patent
Huang et al.

(10) Patent No.: US 10,989,194 B2
(45) **Date of Patent: *Apr. 27, 2021**

(54) COMPRESSOR PUMP STRUCTURE AND COMPRESSOR

(71) Applicant: GREE GREEN REFRIGERATION TECHNOLOGY CENTER CO., LTD. OF ZHUHAI, Zhuhai (CN)

(72) Inventors: Hui Huang, Zhuhai (CN); Zhongcheng Du, Zhuhai (CN); Jia Xu, Zhuhai (CN); Sen Yang, Zhuhai (CN); Liping Ren, Zhuhai (CN); Lingchao Kong, Zhuhai (CN); Shebing Liang, Zhuhai (CN); Jinquan Zhang, Zhuhai (CN); Rongting Zhang, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 209 days.

This patent is subject to a terminal disclaimer.

(21) Appl. No.: 15/998,747

(22) PCT Filed: Feb. 15, 2017

(86) PCT No.: PCT/CN2017/073667
§ 371 (c)(1),
(2) Date: Aug. 16, 2018

(87) PCT Pub. No.: WO2017/140246
PCT Pub. Date: Aug. 24, 2017

(65) Prior Publication Data

US 2019/0226482 A1 Jul. 25, 2019

(30) Foreign Application Priority Data

Feb. 16, 2016 (CN) ..... 201610087410.3

(51) Int. Cl.
*F04B 37/00* (2006.01)
*F04B 27/06* (2006.01)
(Continued)

(52) U.S. Cl.
CPC ..... *F04C 18/356* (2013.01); *F01C 21/0809* (2013.01); *F04C 15/0065* (2013.01);
(Continued)

(58) Field of Classification Search
CPC .... F01B 13/02; F04C 18/356; F04C 15/0065; F04C 15/06; F04C 18/3445; F04B 28/00;
(Continued)

(56) References Cited

U.S. PATENT DOCUMENTS 1,393,802 A * 10/1921 Lupton, Jr. ..... F01B 13/02 123/241
2,703,675 A * 3/1955 Johnson ..... F04B 27/0409 417/462
(Continued)

FOREIGN PATENT DOCUMENTS

CN 2716539 Y 8/2005
CN 1241685 C 2/2006
(Continued)

OTHER PUBLICATIONS

Combined Office Action and Search Report dated Apr. 25, 2017 in Chinese Patent Application No. 201610087410.3, 9 pages (with English translation of categories of cited documents).
(Continued)

*Primary Examiner* — Deming Wan
(74) *Attorney, Agent, or Firm* — Oblon, McClelland, Maier & Neustadt, L.L.P.

(57) ABSTRACT

A compressor pump structure comprises a rotating shaft, a piston, a cylinder, a cylinder sleeve, a lower flange and an upper flange, the central axis of the rotating shaft being
(Continued)

arranged eccentrically with respect to the central axis of the cylinder, the rotating shaft being slidably arranged in the piston, the piston being movably arranged in the cylinder and forming two volume-variable chambers with the cylinder, the piston comprising two first sliding planes arranged opposite one another and two first contacting planes arranged opposite one another, the first contacting plane on the upper side being in sealing contact with the upper flange, and the first contacting plane on the lower side being in sealing contact with the lower flange. Also disclosed is a compressor with the compressor pump structure.

12 Claims, 28 Drawing Sheets

(51) Int. Cl.

| | |
|---|---|
| ***F04B 19/02*** | (2006.01) |
| ***F04B 39/12*** | (2006.01) |
| ***F04B 39/00*** | (2006.01) |
| ***F04C 18/34*** | (2006.01) |
| ***F04C 18/356*** | (2006.01) |
| ***F04C 28/22*** | (2006.01) |
| ***F01C 1/34*** | (2006.01) |
| ***F01C 20/22*** | (2006.01) |
| ***F01C 21/10*** | (2006.01) |
| ***F01C 21/08*** | (2006.01) |
| ***F04C 15/06*** | (2006.01) |
| ***F01B 13/02*** | (2006.01) |
| ***F04C 15/00*** | (2006.01) |
| ***F04C 18/344*** | (2006.01) |
| *F04C 23/00* | (2006.01) |

(52) U.S. Cl.
CPC ..... *F04C 15/06* (2013.01); *F04C 18/34* (2013.01); *F04C 18/3445* (2013.01); *F04C 23/008* (2013.01); *F04C 2240/60* (2013.01)

(58) Field of Classification Search
CPC .... F04B 27/0663; F04B 19/025; F04B 39/12; F04B 39/0005; F01C 1/34; F01C 1/344; F01C 20/22; F01C 21/0809
See application file for complete search history.

(56) References Cited

U.S. PATENT DOCUMENTS

| | | | | |
|---|---|---|---|---|
| 4,207,736 | A * | 6/1980 | van Loo | F01B 13/02 60/39.34 |
| 4,723,895 | A | 2/1988 | Hayase | |
| 5,478,218 | A * | 12/1995 | Gu | F04B 27/0663 417/462 |
| 6,079,376 | A * | 6/2000 | Dillenberg | F01B 13/02 123/44 C |
| 6,206,661 | B1 | 3/2001 | Iida et al. | |
| 2019/0242381 | A1* | 8/2019 | Hu | F04C 18/0215 |

FOREIGN PATENT DOCUMENTS

| | | | |
|---|---|---|---|
| CN | 1959114 | A | 5/2007 |
| CN | 204572458 | U | 8/2015 |
| CN | 204877938 | U | 12/2015 |
| CN | 204877940 | U | 12/2015 |
| CN | 105570128 | A | 5/2016 |
| CN | 105570130 | A | 5/2016 |
| CN | 205533217 | U | 8/2016 |
| CN | 205559280 | U | 9/2016 |

OTHER PUBLICATIONS

Office Action dated Aug. 30, 2017 in Chinese Patent Application No. 201610087410.3.

Office Action dated Nov. 24, 2017 in Chinese Patent Application No. 201610087410.3.

Office Action dated Apr. 8, 2018 in Chinese Patent Application No. 201610087410.3 (with English translation of categories of cited documents).

International Search Report dated May 19, 2017 in Corresponding PCT/CN2017/073667.

* cited by examiner

COMPRESSOR PUMP STRUCTURE AND COMPRESSOR

CROSS-REFERENCE TO RELATED APPLICATIONS

This application claims priority to Chinese patent application No. 201610087410.3, filed with Chinese Patent Office on Feb. 16, 2016, entitled "Compressor Pump Structure and Compressor", which is incorporated herein by reference in its entirety.

FIELD OF THE INVENTION

The present disclosure relates to the field of air compression technology, and in particular, relates to a compressor pump structure and a compressor.

DESCRIPTION OF RELATED ART

In an existing pump structure of a rotating-cylinder piston compressor, a cylinder and a cylinder sleeve are mounted coaxially, with a sliding friction pair. The cylinder and the piston are installed in a cooperative manner. A piston is a non-circular structure for preventing the piston from self-rotation. Both intake and exhaust passages are distributed on the cylinder sleeve.

During operation of the compressor, as the linear velocity of the friction pair in the circumferential direction of the cylinder and the cylinder sleeve and the area of the friction pair are very large, the frictional power loss of the friction pair is large. As the cylinder needs to be radially spaced, the span of a piston supporting portion of a rotating shaft is large. The deformation and contact stress are very large under the action of unit force. The outer round contour of the piston includes two arc surfaces and two parallel surfaces distributed therebetween, and a cylinder piston hole matched with the piston is also formed by two arc surfaces and two parallel surfaces, resulting in a complex structure and relatively high processing cost.

SUMMARY OF THE INVENTION

Embodiments of the present disclosure provide a compressor pump structure and a compressor to solve the problems in the prior art of the complexity of a piston and cylinder piston hole structure, and relatively high processing cost.

To solve the technical problems described above, according to one aspect of the present disclosure, a compressor pump structure is provided, comprising a rotating shaft, a piston, a cylinder, a cylinder sleeve, an upper flange and a lower flange, the central axis of the rotating shaft being arranged eccentrically with respect to the central axis of the cylinder, the rotating shaft being slidably arranged in the piston, the piston being movably arranged in the cylinder and forming two volume-variable chambers with the cylinder, the piston comprising two first sliding planes arranged opposite one another and two first contacting planes arranged opposite one another, the first contacting plane on the upper side being in sealing contact with the upper flange, and the first contacting plane on the lower side being in sealing contact with the lower flange.

In some embodiments, the compressor pump structure further comprises a rolling assembly, the cylinder being rotatably arranged within the cylinder sleeve, and the rolling assembly being arranged between the cylinder and the cylinder sleeve and forming rolling contact with the cylinder and the cylinder sleeve respectively.

In some embodiments, the rolling assembly comprises a retainer and roller pins, the retainer being arranged between the cylinder and the cylinder sleeve, the retainer being circumferentially provided with a plurality of mounting slots, and the roller pins being rollably arranged in the mounting slots.

In some embodiments, the piston further comprises first arc surfaces connected between the two first sliding planes, and the cylinder comprises a first sliding groove that goes through the cylinder axially, the first sliding groove comprising second sliding planes in sliding fit with the first sliding planes and second arc surfaces connected between the two second sliding planes, with the volume-variable chambers being formed between the second are surface and the first arc surface.

In some embodiments, the cylinder sleeve comprises a step hole, and the cylinder comprises an axial locating portion and a rotation fitting portion axially protruding from the axial locating portion, the axial locating portion being axially restrained in a large hole segment of the step hole, and the rotation fitting portion being rotationally arranged in a small hole segment of the step hole, and the rolling assembly being arranged between the axial locating portion and an inner peripheral wall of the large hole segment of the step hole.

In some embodiments, the rotation fitting portion comprises two isolation barriers which are spaced apart from each other, the outer peripheries of the isolation barriers being in scaling contact with an inner peripheral wall of the small hole segment of the step hole, and inner side walls of the isolation barriers being in sealing contact with the first sliding planes of the piston.

In some embodiments, the upper flange is provided with an intake port, an exhaust port, a first intake passage and a first exhaust passage, the intake port being communicated with the first intake passage, the exhaust port being communicated with the first exhaust passage; and the end surface of the cylinder sleeve where the small hole segment is located is provided with a first communication passage that communicates the first intake passage with one volume-variable chamber, and a second communication passage that communicates the first exhaust passage with the other volume-variable chamber.

In some embodiments, the piston further comprises two first arc surfaces connected between the two first sliding planes; at the inner periphery of the cylinder are provided two sliders which are arranged opposite one another; and on the opposite sides of the two sliders are formed second sliding planes in sliding fit with the first sliding planes; on the outer peripheries of the sliders are formed arc surfaces in sealing contact with an inner peripheral wall of the cylinder, and the two first arc surfaces of the piston form the volume-variable chambers with the inner peripheral wall of the cylinder respectively.

In some embodiments, the rotating shaft comprises a long shaft segment, a piston supporting segment and a short shaft segment, the long shaft segment being fit with the upper flange, the piston supporting segment being in sliding fit with the piston, and the short shaft segment being fit with the lower flange.

In some embodiments, the piston is provided with a second sliding groove that goes through the cylinder axially, the second sliding groove comprising two rotating shaft supporting planes that are parallel to each other, the piston supporting segment comprising piston supporting planes in match with the two rotating shaft supporting planes of the rectangular second sliding groove, the two piston supporting planes being parallel to each other.

In some embodiments, in the middle of the rotating shaft is formed an axially-guided oil hole that runs through the entire rotating shaft, and the piston supporting planes are provided with oil grooves, and the piston supporting segment is radially provided with radially-guided oil holes that communicate the axially-guided oil hole with the oil grooves.

In some embodiments, the cylinder is rotatably arranged within the cylinder sleeve, and an annular groove is formed on an outer peripheral wall of the cylinder, the outer peripheral wall in match with the cylinder sleeve.

According to another aspect of the present disclosure, a compressor is further provided, comprising a compressor pump structure, which is the aforementioned one.

The compressor pump structure according the present disclosure comprises a rotating shaft, a piston, a cylinder, a cylinder sleeve, an upper flange and a lower flange, the central axis of the rotating shaft being arranged eccentrically with respect to the central axis of the cylinder, the rotating shaft being slidably arranged in the piston, the piston being movably arranged in the cylinder and forming two volume-variable chambers with the cylinder. The piston comprising two first sliding planes arranged opposite one another and two first contacting planes arranged opposite one another. The first contacting plane on the upper side is in sealing contact with the upper flange, and the first contacting plane on the lower side is in sealing contact with the lower flange. As the piston comprises the two first sliding planes arranged opposite one another and the two first contacting planes arranged opposite one another, its main body structure is relatively regular, and the structure of a cylinder piston hole matched therewith is also relatively regular, and the outer contour of the piston is mainly composed of parallel planes. In this way, the structural complexity of the piston and the cylinder piston hole is reduced, the processing difficulty of the piston and the cylinder piston hole is decreased, and the processing costs is lowered.

REFERENCE SIGNS

Figure 1:
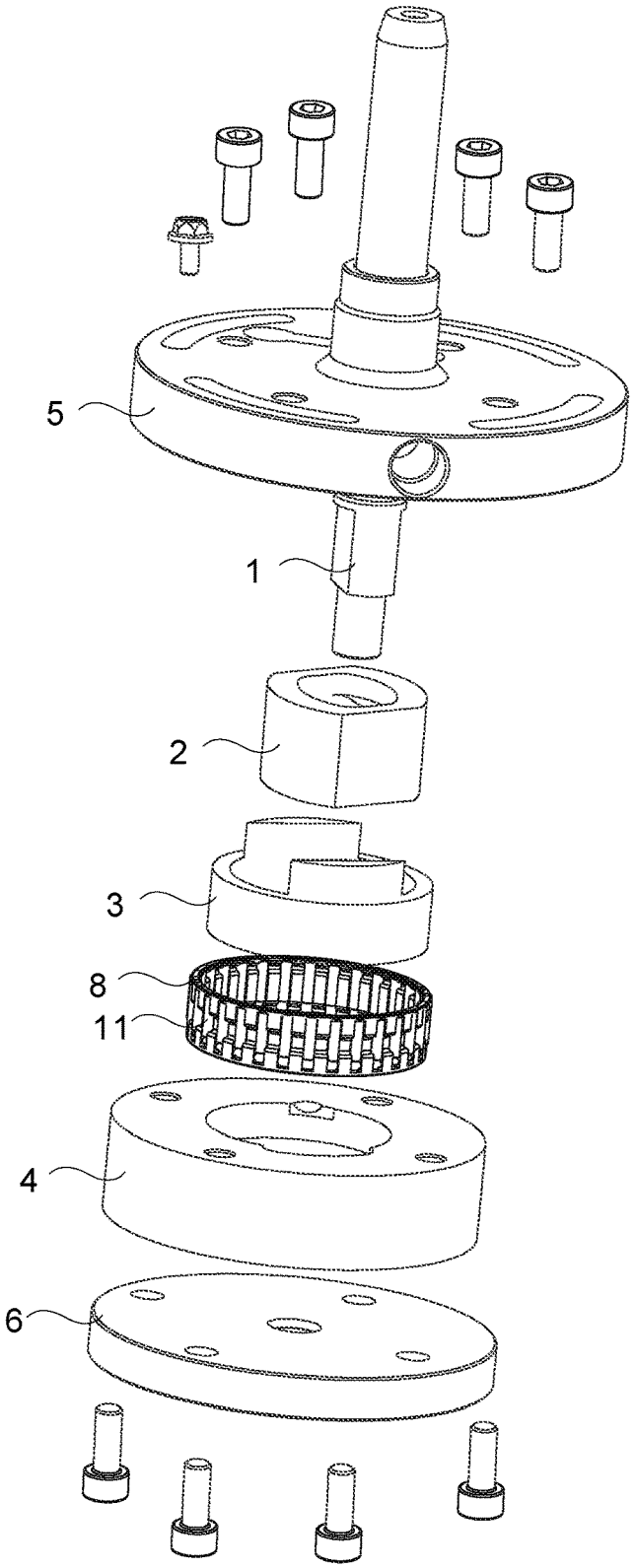
FIG. 1 is an exploded structure diagram of a compressor pump structure in some embodiments of the present disclosure.
Figure 2:
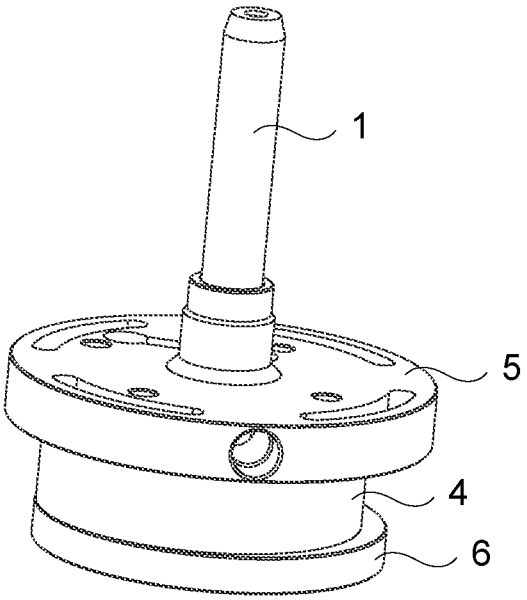
FIG. 2 is a three-dimensional structure diagram of the compressor pump structure in some embodiments of the present disclosure.
Figure 3:
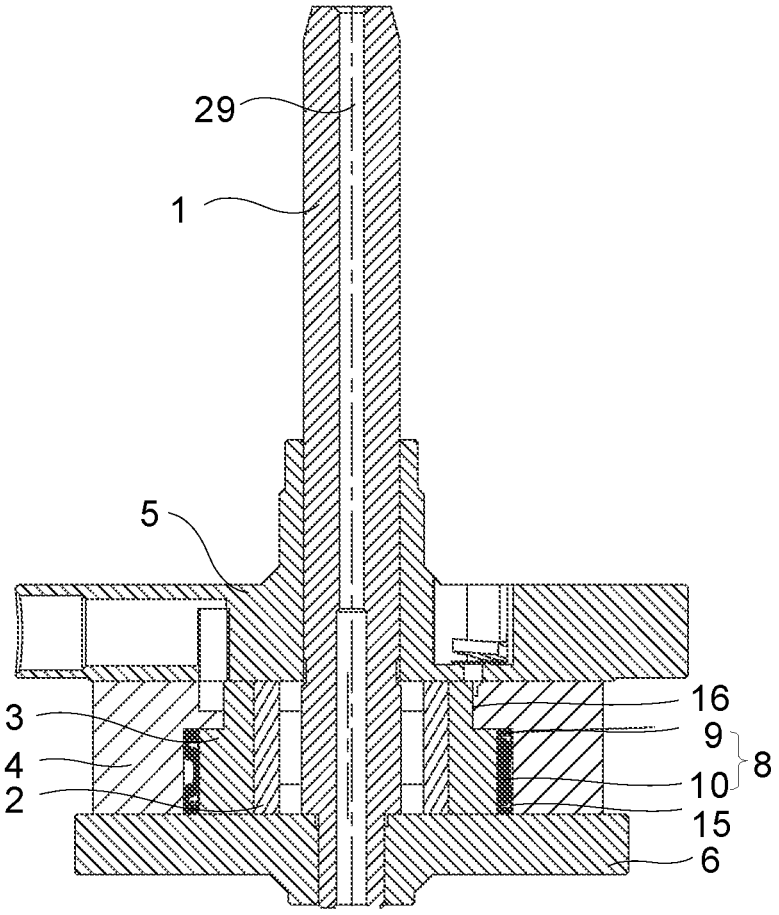
FIG. 3 is a longitudinal sectional structure diagram of the compressor pump structure in some embodiments of the present disclosure.
Figure 4:
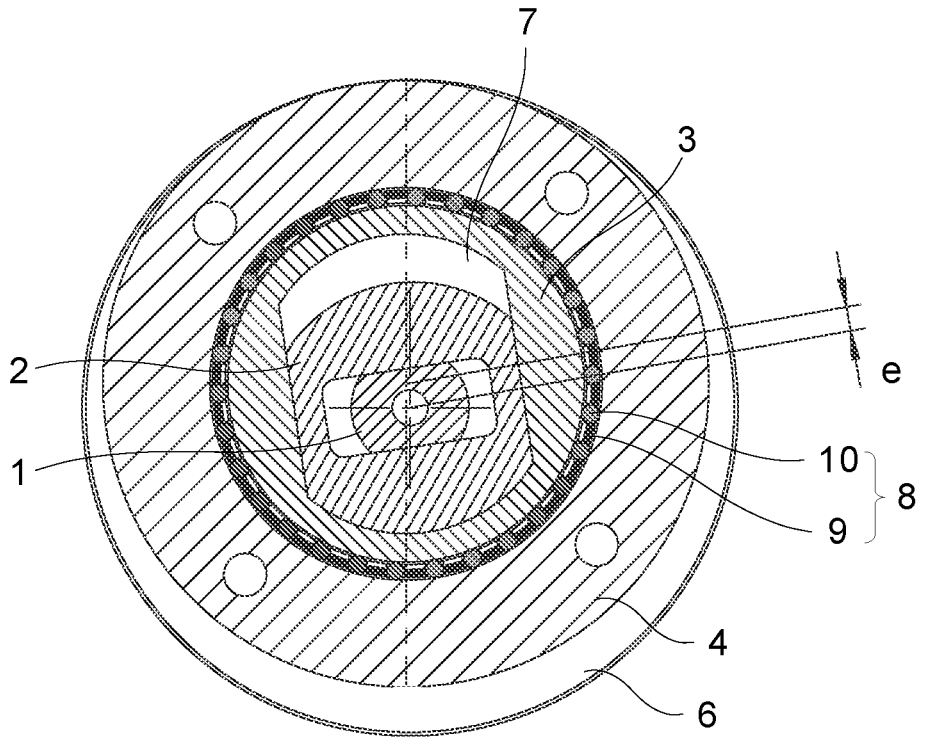
FIG. 4 is a transverse sectional structure diagram of the compressor pump structure in some embodiments of the present disclosure.
Figure 5:
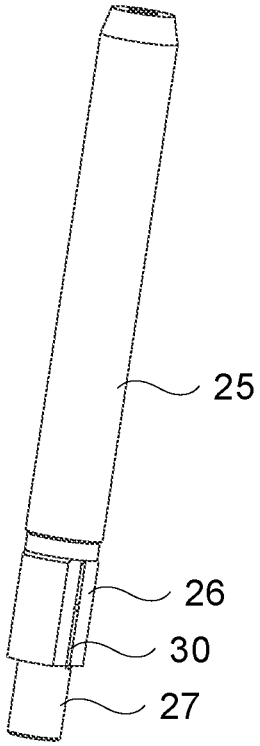
FIG. 5 is a three-dimensional structure diagram of a rotating shaft of the compressor pump structure in some embodiments of the present disclosure.
Figure 6:
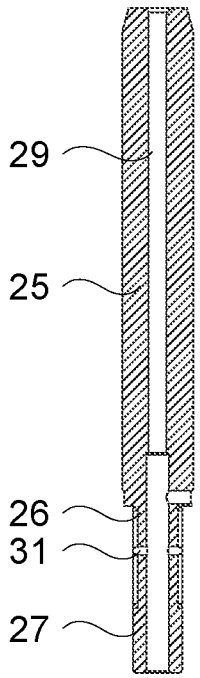
FIG. 6 is a sectional structure diagram of the rotating shaft of the compressor pump structure in some embodiments of the present disclosure.
Figure 7:
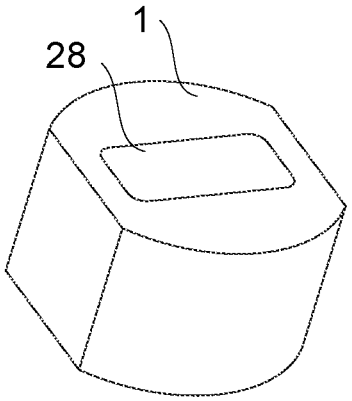
FIG. 7 is a three-dimensional structure diagram of a piston of the compressor pump structure in some embodiments of the present disclosure.
Figure 8:
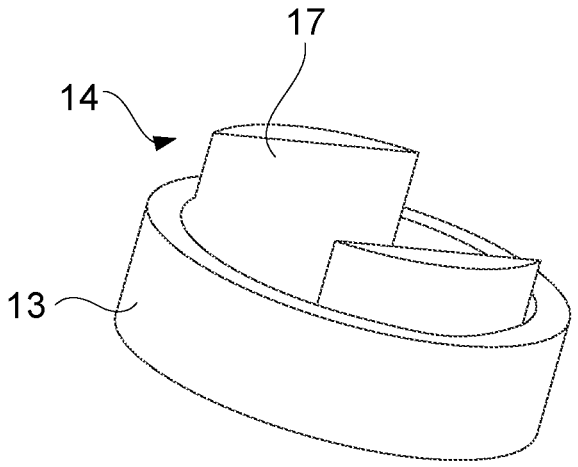
FIG. 8 is a three-dimensional structure diagram of a cylinder of the compressor pump structure in some embodiments of the present disclosure.
Figure 9:
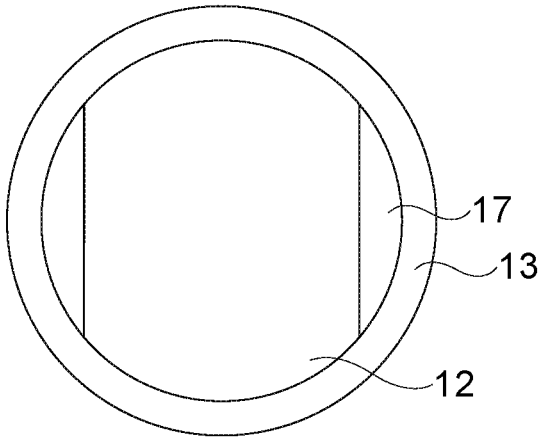
FIG. 9 is a front structure diagram of the cylinder of the compressor pump structure in some embodiments of the present disclosure.
Figure 10:
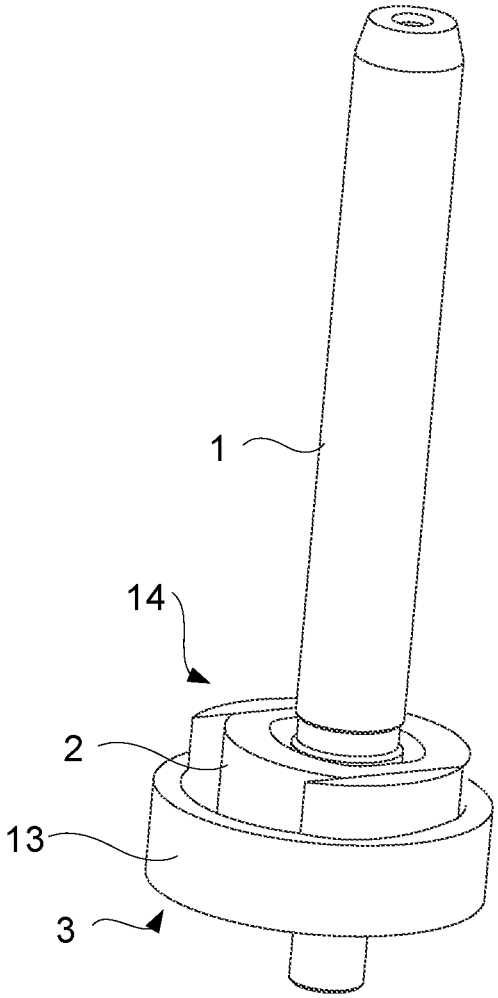
FIG. 10 is an assembly structure diagram of the piston and the cylinder of the compressor pump structure in some embodiments of the present disclosure.
Figure 11:
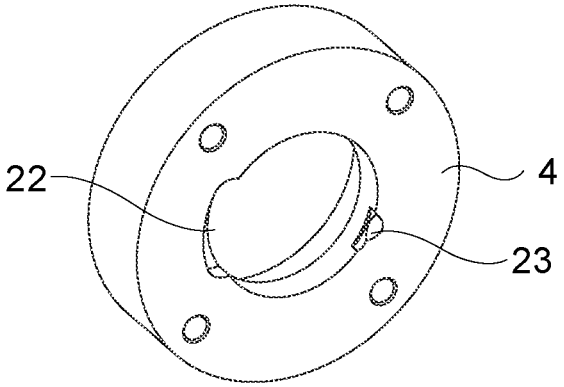
FIG. 11 is a three-dimensional structure diagram of a cylinder sleeve of the compressor pump structure in some embodiments of the present disclosure.
Figure 12:
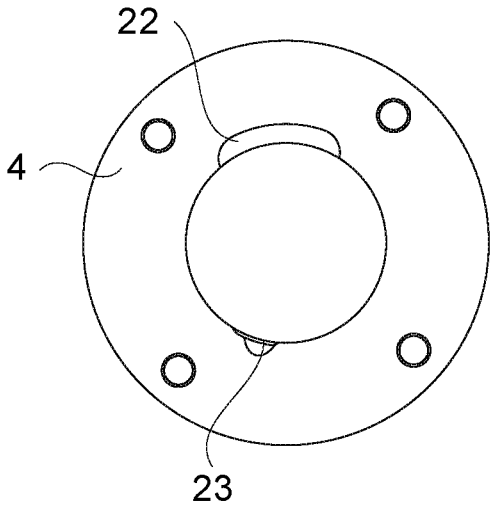
FIG. 12 is a front structure diagram of the cylinder sleeve of the compressor pump structure in some embodiments of the present disclosure.
Figure 13:
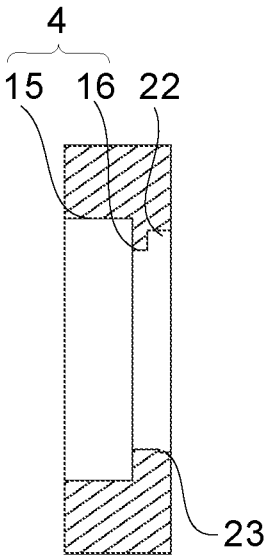
FIG. 13 is a sectional structure diagram of the cylinder sleeve of the compressor pump structure in some embodiments of the present disclosure.
Figure 14:
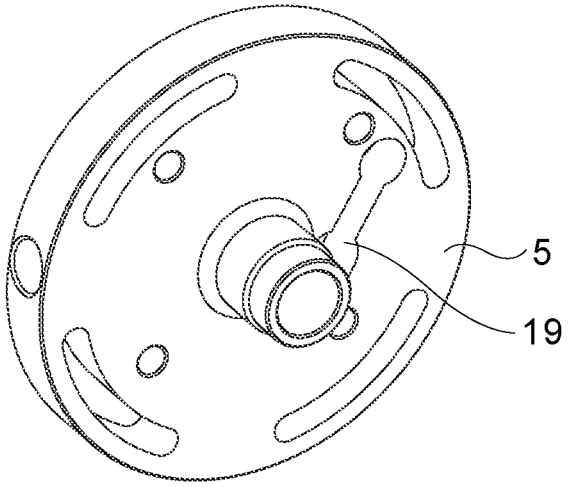
FIG. 14 is a first axonometric structure diagram of an upper flange of the compressor pump structure in some embodiments of the present disclosure.
Figure 15:
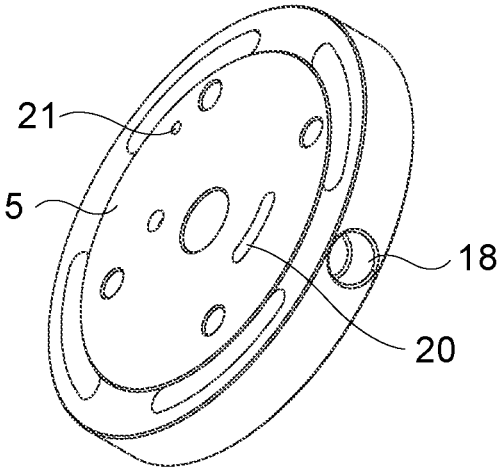
FIG. 15 is a second axonometric structure diagram of the upper flange of the compressor pump structure in some embodiments of the present disclosure.

1. rotating shaft; 2. piston; 3. cylinder; 4. cylinder sleeve; 5. upper flange; 6. lower flange; 7. volume-variable chamber; 8. rolling assembly; 9. retainer; 10. rolling pin; 11. mounting groove; 12. first sliding groove; 13. axial locating portion; 14. rotation fitting portion; 15. large hole segment; 16. small hole segment; 17. isolation barrier; 18. intake port; 19. exhaust port; 20. first intake passage; 21. first exhaust passage; 22. first communication passage; 23. second communication passage; 24. slider; 25. long shaft segment; 26. piston supporting segment; 27. short shaft segment; 28. second sliding groove; 29. axially-guided oil hole; 30. oil groove; 31. radially-guided oil hole; 32. annular groove.

DESCRIPTION OF THE INVENTION

The present disclosure is further described in detail below in conjunction with the accompanying drawings and specific embodiments, but the present disclosure is not limited thereto.

Referring to FIGS. 1-28, the present disclosure provides a compressor pump structure, comprising a rotating shaft 1, a piston 2, a cylinder 3, a cylinder sleeve 4, an upper flange 5 and a lower flange 6. The central axis of the rotating shaft 1 being arranged eccentrically with respect to the central axis of the cylinder 3. The rotating shaft 1 is slidably arranged in the piston 2, the piston 2 is movably arranged in the cylinder 3 and forming two volume-variable chambers 7 with the cylinder 3. The piston 2 comprises two first sliding planes arranged opposite one another and two first contacting planes arranged opposite one another. The first contacting plane on the upper side is in sealing contact with the upper flange 5, and the first contacting plane on the lower side is in sealing contact with the lower flange 6.

As the piston 2 comprises the two first sliding planes arranged opposite one another and the two first contacting planes arranged opposite one another, its main body structure is relatively regular, and the structure of a cylinder piston hole matched therewith is also relatively regular. The outer contour of the piston is mainly composed of parallel planes; in this way, the structural complexity of the piston 2 and the cylinder piston hole is reduced, the processing difficulty of the piston 2 and the cylinder piston hole is decreased, and the processing costs is lowered.

In addition, as the two first contacting planes of the piston 2 contact the upper flange 5 and the lower flange 6 respectively, the piston 2 is positioned circumferentially through the upper flange 5 and the lower flange 6. Thus, the piston does not need to be positioned axially by the cylinder 3, and the thickness of the cylinder 3 is not increased axially. In this way, it reduces the height of the cylinder 3, the span of a piston supporting portion of the rotating shaft 1, a contact stress between the rotating shaft 1 and the flanges, and the abrasion of the flanges. And it improves the energy efficiency and reliability of the compressor.

Figure 26:
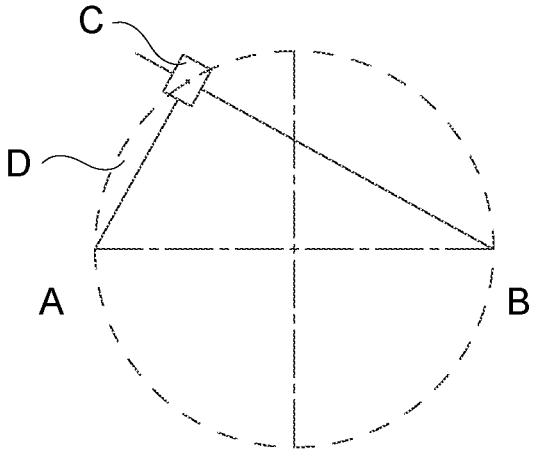
FIG. 26 is a diagram of piston movement principle of the compressor pump structure in some embodiments of the present disclosure.

Referring to FIG. 26, which is a diagram of piston movement principle of the compressor pump structure in some embodiments of the present disclosure. A is the center of the cylinder, B is the center of the rotating shaft, C is the center of the piston, and D is the motion trajectory of the mass center of the piston. There is an eccentric quantity e between the cylinder center A and the rotating shall center B, i.e. an eccentric quantity of the compressor. The eccentric quantity remains unchanged during movement of the piston 2. In this case, the piston 2 is equivalent to a slider of a cross slider mechanism, and the distance from the cylinder center to the piston center and the distance from the rotating shaft center to the piston center are equivalent to connecting links L1 and L2 respectively, thus forming a main body structure of the cross slider principle.

As the eccentric distance between the rotating shaft 1 and the cylinder 3 is unchanged, and the rotating shaft 1 and the cylinder 3 rotate about their respective axes during movement thereof, with the mass center being unchanged. Thus the piston 2 rotates stably and continuously during movement within the cylinder 3, thereby effectively alleviating vibration of the compressor pump structure, and ensuring regular volume variations of the volume-variable chambers 7 and reducing the clearance volume, thus improving the operation stability of the compressor pump structure, and increasing the work reliability of the compressor.

Referring to FIGS. 1 to 4 and 16, according to some embodiments of the present disclosure, the compressor pump structure further comprises a rolling assembly 8. The cylinder 3 is rotatably arranged within the cylinder sleeve 4. The rolling assembly 8 is arranged between the cylinder 3 and the cylinder sleeve 4 and forming rolling contact with the cylinder 3 and the cylinder sleeve 4 respectively. The rolling assembly 8 is arranged between an outer peripheral wall of the cylinder 3 and an inner peripheral wall of the cylinder sleeve 4, so that sliding friction between the cylinder 3 and the cylinder sleeve 4 is changed to rolling friction, which reduces the friction power loss, decrease the friction loss between the cylinder 3 and the cylinder sleeve 4 and increase the service life of the cylinder 3 and the cylinder sleeve 4.

In some embodiments, the rolling assembly 8 comprises a retainer 9 and roller pins 10. The retainer 9 is arranged between the cylinder 3 and the cylinder sleeve 4. The retainer 9 is circumferentially provided with a plurality of mounting slots 11. The roller pins 10 is rollably arranged in the mounting slots 11. The retainer 9 is mounted coaxially with the cylinder 3, and the cylinder sleeve 4 is mounted coaxially and cooperatively with the retainer 9. The retainer 9 positions the roller pins 10 so that the plurality of roller pins 10 are retained at uniform and fixed intervals circumferentially of the cylinder 3. Thus, the cylinder 3 and the cylinder sleeve 4 are radially supported uniformly and stably during rolling support by the roller pins 10. The structural stability and force-bearing uniformity of the rolling assembly 8 is maintained, and the performance of the rolling assembly 8 is improved. The roller pins 10 extend along the axial direction of the cylinder 3, and there is radial support at a great length in the axial direction, to ensure uniformity of radial force application on the cylinder 3 in the entire axial direction. Of course, the roller pins 10 here are also replaced by other rolling parts, such as balls; and accordingly, the retainer 9 is also any other structure that circumferentially restrain the rolling parts at uniform intervals.

Referring to FIGS. 7 to 10, the piston 2 further comprises first arc surfaces connected between the two first sliding planes. The cylinder 3 comprises a first sliding groove 12 that goes through the cylinder axially. The first sliding groove 12 comprises second sliding planes in sliding fit with the first sliding planes and second arc surfaces connected between the two second sliding planes, with the volume-variable chambers 7 being formed between the second arc surface and the first are surface. The piston 2 is arranged in the first sliding groove 12 and slides along the two second sliding planes of the first sliding groove 12, and the two first arc surface of the piston 2 and the two second are surface of the cylinder 3 form the volume-variable chambers 7, so that intake and exhaust operations are accomplished through volume variations of the two volume-variable chambers 7.

The piston 2 is provided with a second sliding groove 28 that goes through the cylinder axially. The second sliding groove 28 comprises two rotating shaft supporting planes that are parallel to each other. The rotating shaft 1 comprises a piston supporting segment 26 in sliding fit with the second sliding groove 28. The piston supporting segment 26 comprises piston supporting planes in match with the two rotating shaft supporting planes of the rectangular second sliding groove 28, the two piston supporting planes being parallel to each other.

The two first contacting planes of the piston 2 are parallel to each other, and are in sealing contact and sliding fit with the upper flange 5 and the lower flange 6 respectively. The two first sliding planes arranged parallel of the piston 2 are matched with the two second sliding planes arranged in parallel of the cylinder 3 to achieve reciprocation, thus forming the first connecting link of the cross-slider principle. The two rotating shaft supporting planes arranged in parallel of the rectangular second sliding groove formed in the piston 2 are matched with the two piston supporting planes arranged in parallel of the rotating shaft 1 to achieve reciprocation, thus forming the second connecting link of the cross slider principle. Under the cooperative action of the rotating shaft 1 and the cylinder 3, the piston 2 performs circular motion with the eccentric quantity e as the radius, and with the connecting line between the rotating shaft center and the cylinder center as the diameter, so that the volumes of the two volume-variable chambers 7 change continuously, to accomplish intake and exhaust operations of the cylinder 3.

In some embodiments, the cylinder sleeve 4 comprises a step hole. The cylinder 3 comprises an axial locating portion 13 and a rotation fitting portion 14 axially protruding from the axial locating portion 13. The axial locating portion 13 is axially restrained in a large hole segment 15 of the step hole, and the rotation fitting portion 14 is rotationally arranged in a small hole segment 16 of the step hole. The rolling assembly 8 is arranged between the axial locating portion 13 and an inner peripheral wall of the large hole segment 15 of the step hole.

The cylinder sleeve 4 is axially positions the cylinder 3 through a step of the step hole, and also axially positions the rolling assembly 8 in the large hole segment 15 of the step hole, so that the rolling assembly 8 is retained at a defined axial position. The rotation fitting portion 14 is in rotation fit with the small hole segment 16 of the step hole, so the outer diameter of the rotation fitting portion 14 is smaller than that of the axial locating portion 13. As the volume-variable chambers 7 communicate with an intake port and an exhaust port of the upper flange 5, communication holes are formed at positions of the axial locating portion 13 corresponding to the volume-variable chambers 7, so that the volume-variable chambers 7 communicate with the intake port or the exhaust port when moving circumferentially to a corresponding position, to accomplish intake or exhaust operations.

In some embodiments, the rotation fitting portion 14 comprises two isolation barriers 17 which are spaced apart from each other. The outer peripheries of the isolation barriers 17 is in scaling contact with an inner peripheral wall of the small hole segment 16 of the step hole, and inner side walls of the isolation barriers 17 is in scaling contact with the first sliding planes of the piston 2. The inner side walls of the isolation barriers 17 are flush with the inner sides of the axial locating portion 13, both being two second sliding planes parallel to each other, thus ensuring the sliding guidance effect on the piston 2. As the two isolation barriers 17 are spaced apart, and the outer peripheries thereof are in scaling contact with an inner peripheral wall of the small hole segment 16 of the step hole, the intake port and the exhaust port of the upper flange 5 is communicated with the volume-variable chambers 7 through the spacing between the two isolation barriers 17. The two volume-variable chambers 7 are isolated through cooperation between the two isolation barriers 17 and the piston 2, to ensure separation between intake and exhaust, and guarantee gas compression.

Referring to FIGS. 11 to 15, the upper flange 5 is provided with the intake port 18, the exhaust port 19, a first intake passage 20 and a first exhaust passage 21. The intake port 18 is communicated with the first intake passage 20. The exhaust port 19 is communicated with the first exhaust passage 21. The end surface of the cylinder sleeve 4 where the small hole segment 16 is located is provided with a first communication passage 22 that communicates the first intake passage 20 with one volume-variable chamber 7, and a second communication passage 23 that communicates the first exhaust passage 21 with the other volume-variable chamber 7. The first intake passage 20 and the first communication passage 22 are both elongated holes, and the first exhaust passage 21 and the second communication passage 23 are both small holes; and the intake volume is greater than the exhaust volume, such that during intake, the compressor pump structure sucks enough gas. During compression, the volume-variable chambers 7 become smaller to achieve gas compression, and the volumes of the first exhaust passage 21 and the second communication passage 23 becomes smaller to increase the gas compression ratio, improve the gas compression effect and enhance the gas compression performance of the compressor.

Providing the first exhaust passage 21 on the upper end face of the upper flange 5 communicates with the exhaust port 19. An exhaust valve plate and a valve plate baffle are mounted on the exhaust port 19, the exhaust valve plate and the valve plate baffle being fixed within a groove at the exhaust port 19 through valve screws so that the exhaust valve plate just covers the exhaust port 19. The circle formed by the center of the upper flange 5 is eccentric with respect to the center of a rotating shaft hole of the upper flange 5, with the eccentric quantity e, which is an eccentric quantity of the entire compressor pump structure.

The center of the lower flange 6 is eccentric with respect to the center of a rotating shaft hole of the lower flange 6, with the eccentric quantity e, which is an eccentric quantity of the complete machine. The compressor travel distance S=2*e. The rotating shaft holes of the upper and lower flanges are mounted coaxially during assembly.

The rotating shaft 1 comprises a long shaft segment 25, the piston supporting segment 26 and a short shaft segment 27. The long shaft segment 25 is fit with the upper flange 5, the piston supporting segment 26 is in sliding fit with the piston 2, and the short shaft segment 27 is fit with the lower flange 6.

In the middle of the rotating shaft 1 is formed an axially-guided oil hole 29 that runs through the entire rotating shaft 1. The piston supporting planes are provided with oil grooves 30. The piston supporting segment 26 is radially provided with radially-guided oil holes 31 that communicate the axially-guided oil hole 29 with the oil grooves 30. The radially-guided oil holes 31 convey lubricating oil in the axially-guided oil hole 29 into the oil grooves 30 formed in the piston supporting planes, to lubricate and cool the piston supporting planes and the rotating shaft supporting planes and reduce friction loss between the rotating shaft 1 and the piston 2.

Figure 16:
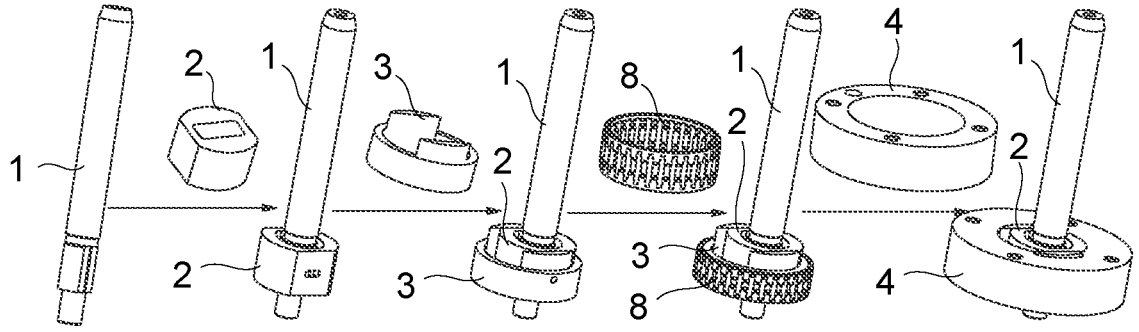
FIG. 16 is a schematic structure diagram of a pump assembly process of the compressor pump structure in some embodiments of the present disclosure.

Referring to FIG. 16, during assembly of the compressor pump structure, first the rotating shaft 1 is mounted into the second sliding groove 28 of the piston 2. Then the assembled rotating shaft 1 and piston 2 are placed into the first sliding groove 12 of the cylinder 3. The rolling assembly 8 is mounted coaxially with the cylinder. After installation of the rolling assembly 8 is completed, the cylinder sleeve 4 is sleeved outside the rolling assembly 8, and the rolling assembly 8 is located within the large hole segment IS of the cylinder sleeve 4, such that the rolling assembly 8 and the cylinder sleeve 4 are mounted axially. Then the upper flange 5 and the lower flange 6 are fixed to the cylinder sleeve 4 through screws, screw holes of the upper flange 5 and the lower flange 6 corresponding to each other, with the eccentric quantity e between the center of the upper flange 5 and lower flange 6 and the rotating shaft center, thus completing assembly of the pump.

Figure 17:
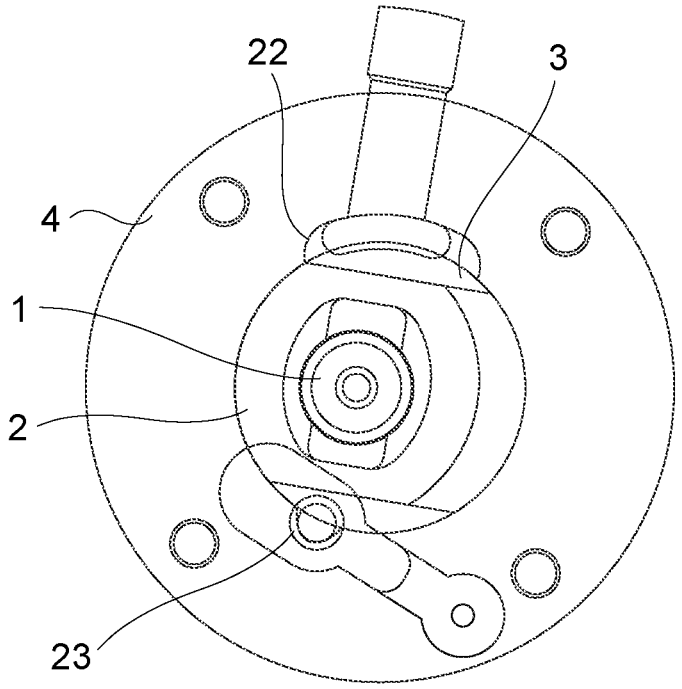
FIG. 17 is a structure diagram of the compressor pump structure in some embodiments of the present disclosure when the piston is in a ready-for-intake state.

Referring to FIGS. 17 to 25, the working process of the compressor pump structure is as follows:

Referring to FIG. 17, first the rotating shaft 1 causes the piston 2 to rotate, and when the first volume-variable chamber 7 at one side of the piston 2 is to be communicated with the first communication passage 22 of the cylinder sleeve 4, the compressor pump structure is in a ready-for-intake state, and at that time the volume of the volume-variable chamber 7 ready for intake is minimum.

Figure 18:
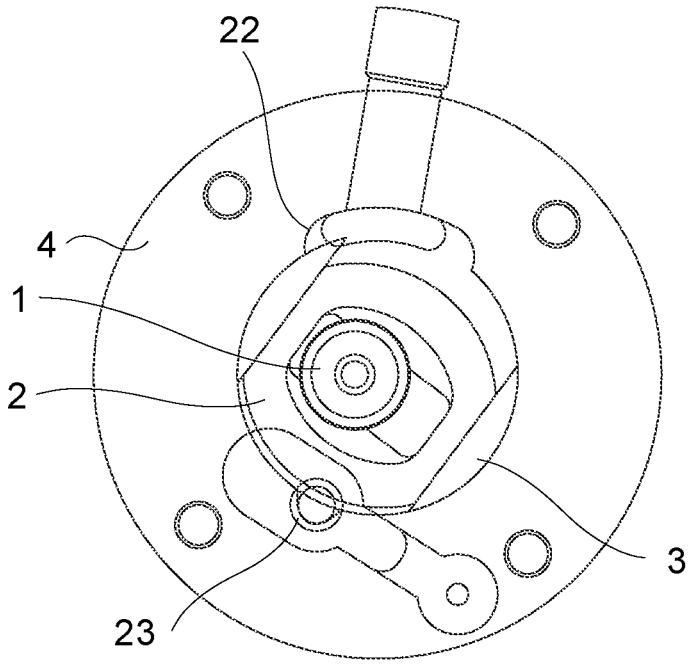
FIG. 18 is a structure diagram of the compressor pump structure in some embodiments of the present disclosure when the piston is in an intake state.

Referring to FIG. 18, as the piston 2 further rotates, the first volume-variable chamber 7 at the intake side of the piston 2 communicates with the first communication passage 22, and communicates with the intake port of the upper flange 5 through the first communication passage 22, and at that time the rotating shaft 1 drives the piston 2 to slide toward the other side, and the volume of the first volume-variable chamber 7 starts to increase to begin intake.

Figure 19:
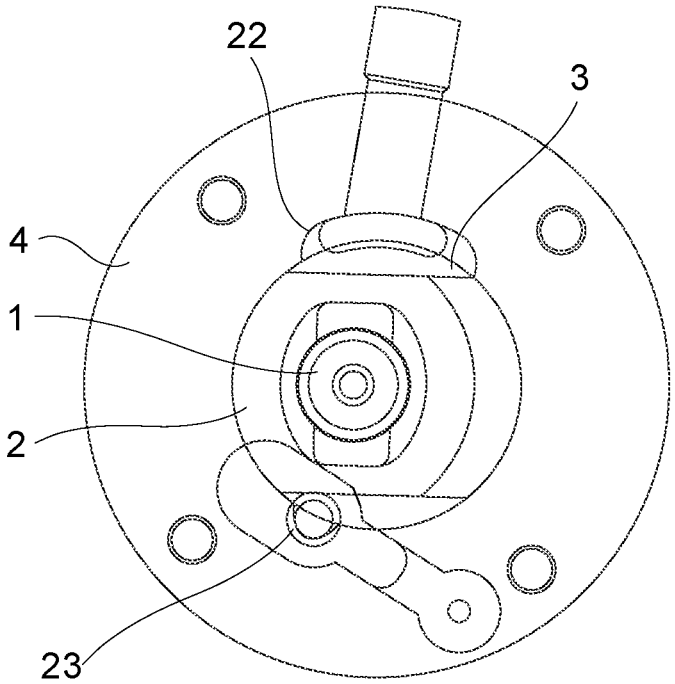
FIG. 19 is a structure diagram of the compressor pump structure in some embodiments of the present disclosure when the piston is in a state where gas intake is to be completed.

Referring to FIG. 19, as the piston 2 further rotates, the first volume-variable chamber 7 is isolated from the first communication passage 22 by the cylinder 3 and no longer sucks gas. At that time the piston 2 moves to a greatest distance, the volume of the first volume-variable chamber 7 is maximum with a greatest amount of gas being sucked therein.

Figure 20:
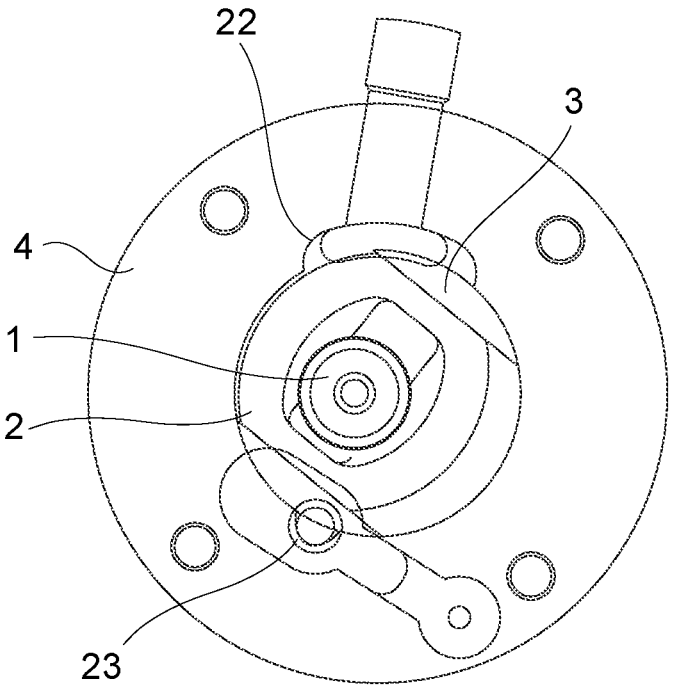
FIG. 20 is a structure diagram of the compressor pump structure in some embodiments of the present disclosure when the piston is in a ready-for-exhaust state.

Referring to FIG. 20, as the piston 2 continues rotating, the first volume-variable chamber 7 is to communicate with the exhaust port of the upper flange 5 though the second communication passage 23 of the cylinder sleeve 4. At that time, driven by the rotating shaft 1, the piston 2 returns, and the gas within the first volume-variable chamber 7 is to be compressed.

Figure 21:
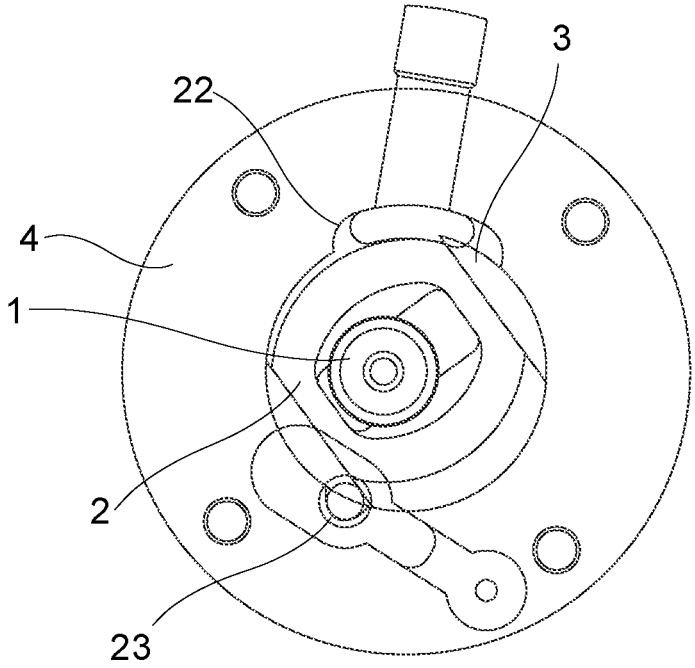
FIG. 21 is a structure diagram of the compressor pump structure in some embodiments of the present disclosure when the piston is in a state of initial stage of gas discharge.
Figure 22:
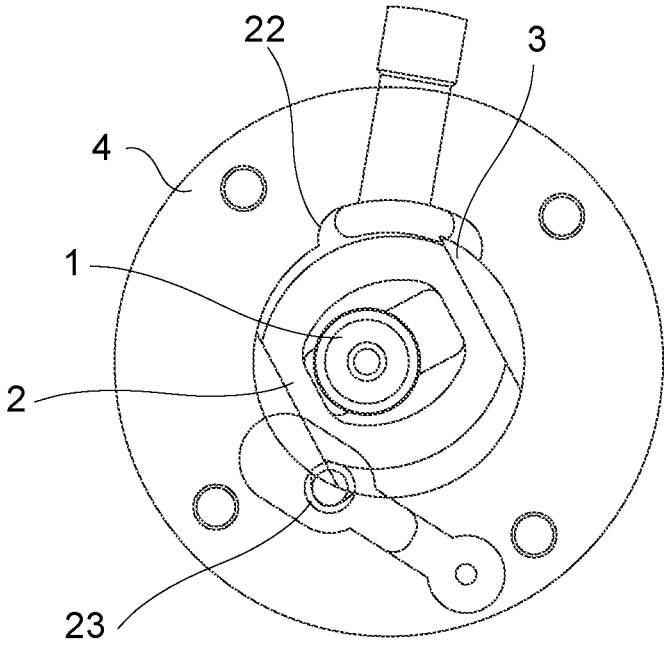
FIG. 22 is a structure diagram of the compressor pump structure in some embodiments of the present disclosure when the piston is in a compression-exhaust process.

Referring to FIGS. 21 and 22, as the piston 2 continues rotating, the first volume-variable chamber 7 communicates with the exhaust port of the upper flange 5. Driven by the rotating shaft 1, the piston 2 continues returning, and the gas within the first volume-variable chamber 7 is further compressed, and the compressed gas starts to be conveyed into the upper flange 5 through the second communication passage 23, and discharged through the exhaust port of the upper flange 5.

Figure 23:
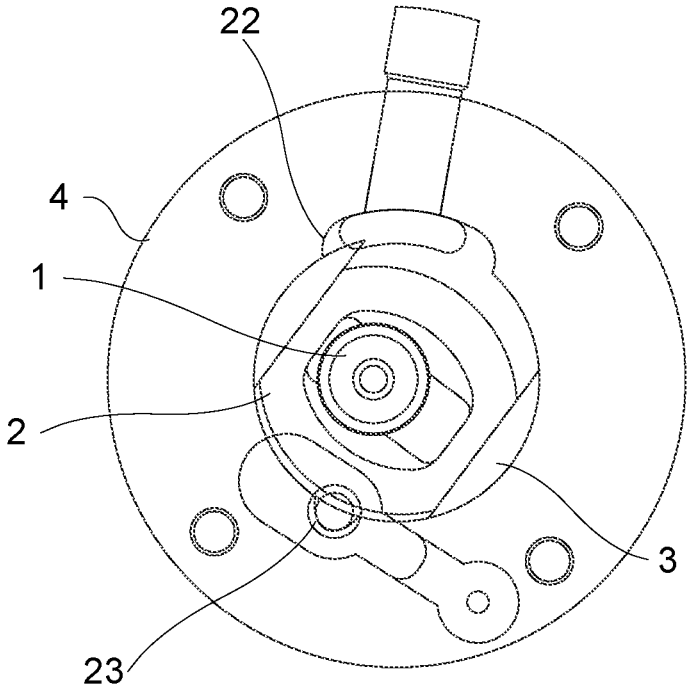
FIG. 23 is a structure diagram of the compressor pump structure in some embodiments of the present disclosure when the piston is in a state where compression-exhaust is to be completed.

Referring to FIG. 23, as the piston 2 continues rotating, the piston 2 continues sliding toward a direction of squeezing the first volume-variable chamber 7. At that time the volume of the first volume-variable chamber 7 becomes further smaller, the gas therein is further compressed, and the compression ratio of the gas becomes greater. When the first volume-variable chamber 7 moves to a position separating from the second communication passage 23, the gas within the first volume-variable chamber 7 is completely discharged.

Figure 24:
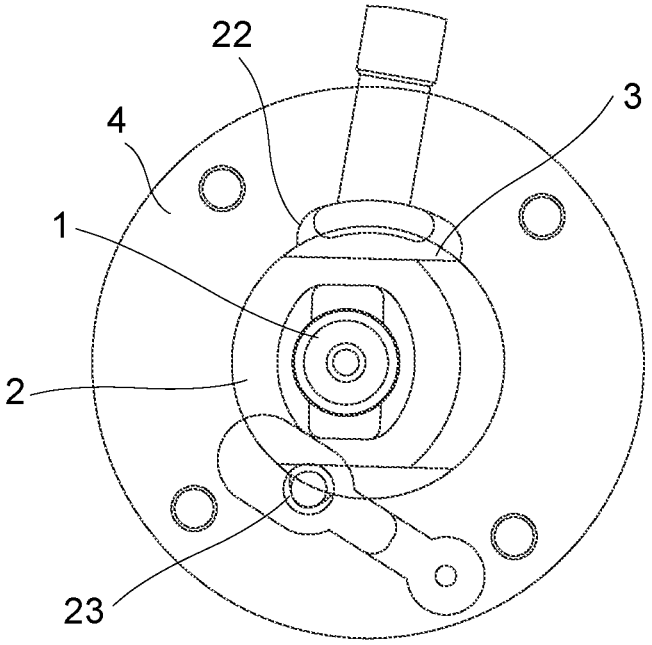
FIG. 24 is a structure diagram of the compressor pump structure in some embodiments of the present disclosure when the piston is in a state where compression-exhaust is completed.
Figure 25:
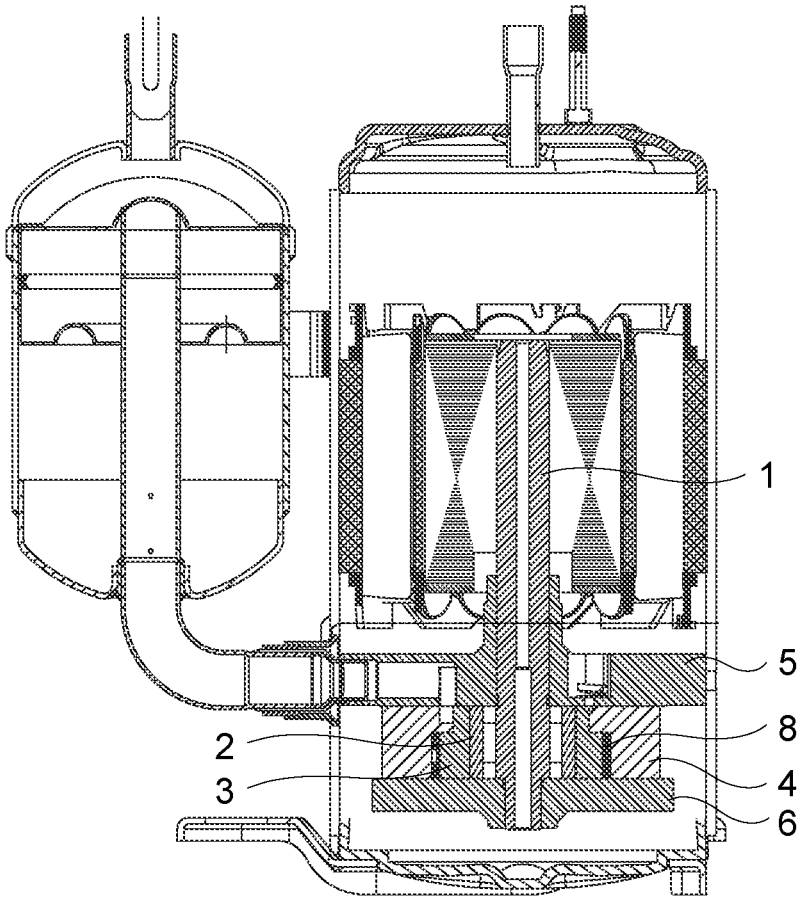
FIG. 25 is a sectional structure diagram of a compressor in some embodiments of the present disclosure.

Referring to FIG. 24, as the piston 2 continues rotating, the first volume-variable chamber 7 is completely separated from the second communication passage 23, and rotates toward a direction communicating with the first communication passage 22. At that time the first volume-variable chamber as in the ready-for-intake state again.

With reciprocating movement of the piston 2 in the cylinder 3, the volumes of the two volume-variable chambers 7 change gradually, to accomplish the intake, compression an exhaust process.

Figure 27:
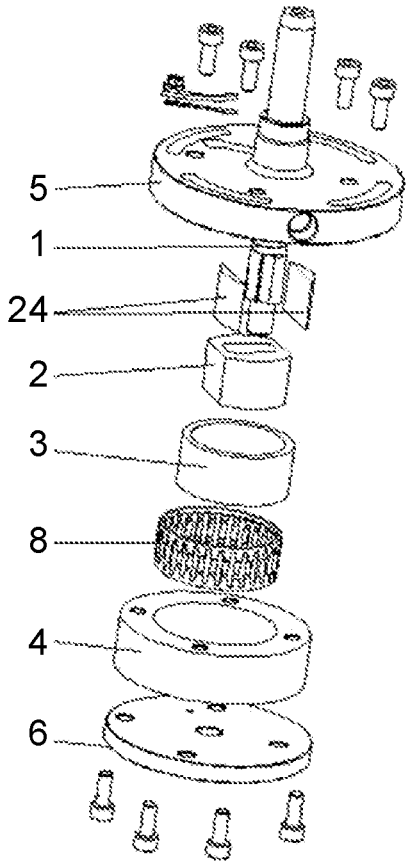
FIG. 27 is an exploded structure diagram of a compressor pump structure in some embodiments of the present disclosure.

Referring to FIG. 27, according to some embodiments of the present disclosure, which is substantially same as the first embodiments, the differences is that, the piston 2 further comprises two first are surfaces connected between the two first sliding planes. At the inner periphery of the cylinder 3 are provided two sliders 24 which are arranged opposite one another. On the opposite sides of the two sliders 24 are formed second sliding planes in sliding fit with the first sliding planes. On the outer peripheries of the sliders 24 are formed are surfaces in sealing contact with an inner peripheral wall of the cylinder 3. The two first arc surfaces of the piston 2 form the volume-variable chambers 7 with the inner peripheral wall of the cylinder 3 respectively.

In some embodiments, the two sliders 24 are rotationally arranged within the cylinder 3, with a sliding passage formed between the two sliders 24, and the piston 2 reciprocates in the sliding passage. The sliders 24 in some embodiments are not formed integrally with the cylinder 3, but formed separately from the cylinder 3. Then arranged oppositely within the cylinder 3 to provide sliding guidance for the piston 2 and enable the piston 2 to rotate relative to the cylinder 3, so as to accomplish intake and exhaust operations of the compressor.

In some embodiments, the height of the two sliders 24 is same as that of the cylinder 3, so it further reduce the height of the cylinder 3, the span of the piston supporting portion of the rotating shaft 1, the contact stress between the rotating shaft 1 and the flanges, and the abrasion of the flanges, and improve the energy efficiency and reliability of the compressor. The height of the cylinder 3 is same as that of the cylinder sleeve 4, the height of the rolling assembly 8 is same as that of the cylinder 3, and the rolling assembly 8 is axially positioned through the upper flange 5 and the lower flange 6, so there is not the step hole into the cylinder sleeve 4, and the processing difficulty of the cylinder sleeve 4 is reduced.

In addition, as the cylinder 3 and the sliders 24 are processed and formed separately, the processing difficulty of the cylinder 3 and the sliders 24 is reduced, and the processing costs are lowered.

Figure 28:
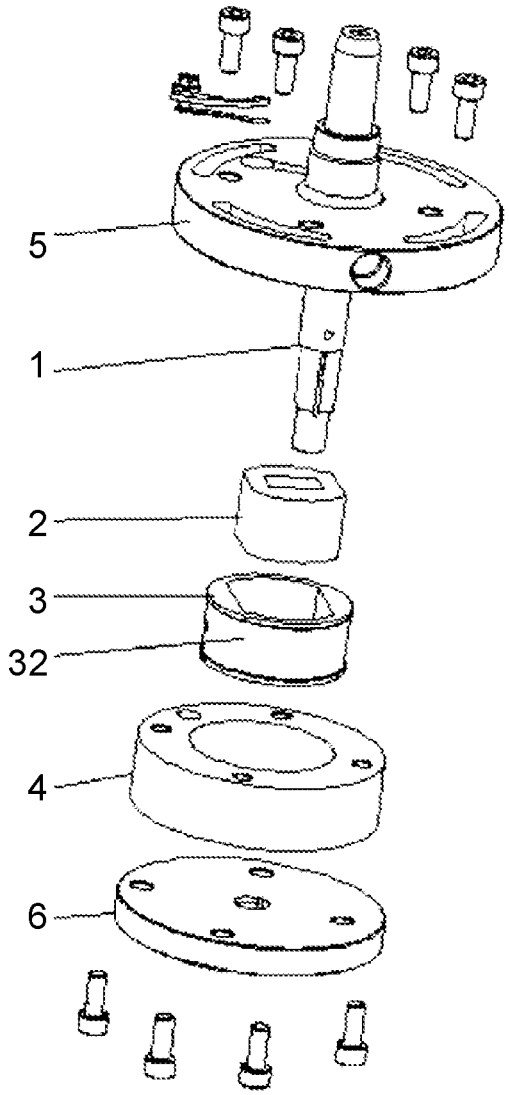
FIG. 28 is an exploded structure diagram of a compressor pump structure in some embodiments of the present disclosure.

Referring to FIG. 28, which shows some embodiments of the present disclosure, which is substantially same as the first embodiments, the differences is that, there is no rolling assembly 8. The cylinder 3 is rotationally arranged within the cylinder sleeve 4. Two second sliding planes are formed directly in the cylinder 3. The piston 2 is slidably arranged within the cylinder 3 and slides under guidance of the second sliding planes. The height of the cylinder 3 is same as that of the cylinder sleeve 4. In addition, a portion is cut away inwardly from the outer peripheral wall of the cylinder 3 to form an annular groove 32, so that the contact area between the cylinder 3 and the cylinder sleeve 4 is decreased to reduce the friction loss.

In some embodiments of the present disclosure, a compressor is further provided, comprising a compressor pump structure, which is the aforementioned one.

Of course, described above are preferred embodiments of the present disclosure. It is noted that to those of ordinary skill in the art, a number of improvements and modifications are also made without departing from the basic principle of the present disclosure, and these improvements and modifications are also be encompassed within the protection scope of the present disclosure.

The invention claimed is:

1. A compressor pump structure, comprising a rotating shaft, a piston, a cylinder, a cylinder sleeve, an upper flange and a lower flange, a central axis of the rotating shaft being arranged eccentrically with respect to a central axis of the cylinder, the rotating shaft being slidably arranged in the piston, the piston being movably arranged in the cylinder and forming two volume-variable chambers with the cylinder; the piston comprising two first sliding planes arranged opposite one another and two first contacting planes arranged opposite one another, the first contacting plane on the upper side being in sealing contact with the upper flange, and the first contacting plane on the lower side being in sealing contact with the lower flange, wherein the compressor pump structure further comprises a rolling assembly, the cylinder being rotatably arranged within the cylinder sleeve, and the rolling assembly being arranged between the cylinder and the cylinder sleeve and forming rolling contact with the cylinder and the cylinder sleeve respectively.

2. The compressor pump structure of claim 1, wherein the rolling assembly comprises a retainer and roller pins, the retainer being arranged between the cylinder and the cylinder sleeve, the retainer being circumferentially provided with a plurality of mounting slots, and the roller pins being rollably arranged in the mounting slots.

3. The compressor pump structure of claim 1 wherein the piston further comprises first arc surfaces connected between the two first sliding planes, and the cylinder comprises a first sliding groove that goes through the cylinder axially, the first sliding groove comprising second sliding planes in sliding fit with the two first sliding planes and second arc surfaces connected between the two second sliding planes, the volume-variable chambers being formed between the second arc surface and the first arc surface.

4. The compressor pump structure of claim 3, wherein the cylinder sleeve comprises a step hole, and the cylinder comprises an axial locating portion and a rotation fitting portion axially protruding from the axial locating portion, the axial locating portion being axially located in a large hole segment of the step hole, and the rotation fitting portion being rotationally arranged in a small hole segment of the step hole, and the rolling assembly being arranged between the axial locating portion and an inner peripheral wall of the large hole segment of the step hole.

5. The compressor pump structure of claim 4, wherein the rotation fitting portion comprises two isolation barriers which are spaced apart from each other, outer peripheries of the two isolation barriers being in sealing contact with an inner peripheral wall of the small hole segment of the step hole, and inner side walls of the isolation barriers being in sealing contact with the two first sliding planes of the piston.

6. The compressor pump structure of claim 4, wherein the upper flange is provided with an intake port, an exhaust port, a first intake passage and a first exhaust passage, the intake port being communicated with the first intake passage, the exhaust port being communicated with the first exhaust passage; and an end surface of the cylinder sleeve where the small hole segment is located is provided with a first communication passage that communicates the first intake passage with one of the two volume-variable chambers, and a second communication passage that communicates the first exhaust passage with another one of the two volume-variable chambers.

7. The compressor pump structure of claim 1 wherein the piston further comprises two first arc surfaces connected between the two first sliding planes; at the inner periphery of the cylinder are provided two sliders which are arranged opposite one another; and on opposite sides of the two sliders are formed second sliding planes in sliding fit with the first sliding planes; on the outer peripheries of the sliders are formed arc surfaces in sealing contact with an inner peripheral wall of the cylinder; and the two first arc surfaces of the piston form the volume-variable chambers with the inner peripheral wall of the cylinder.

8. The compressor pump structure of claim 1, wherein the rotating shaft comprises a long shaft segment, a piston supporting segment and a short shaft segment, the long shaft segment being fit with the upper flange, the piston supporting segment being in sliding fit with the piston, and the short shaft segment being fit with the lower flange.

9. The compressor pump structure of claim 8, wherein the piston is provided with a rectangular second sliding groove that goes through the cylinder axially, the rectangular second sliding groove comprising two rotating shaft supporting planes that are parallel to each other, the piston supporting segment comprising piston supporting planes in match with the two rotating shaft supporting planes of the rectangular second sliding groove, the two piston supporting planes being parallel to each other.

10. The compressor pump structure of claim 9, wherein in the middle of the rotating shaft is formed an axially-guided oil hole that runs through the entire rotating shaft, and the piston supporting planes are provided with oil grooves, and the piston supporting segment is radially provided with radially-guided oil holes that communicate the axially-guided oil hole with the oil grooves.

11. The compressor pump structure of claim 1, wherein the cylinder is rotatably arranged within the cylinder sleeve, and an annular groove is formed on an outer peripheral wall of the cylinder, the outer peripheral wall in match with the cylinder sleeve.

12. A compressor, comprising a compressor pump structure described in claim 1.

* * * * *